US010918165B2

(12) United States Patent
Chen

(10) Patent No.: US 10,918,165 B2
(45) **Date of Patent: *Feb. 16, 2021**

(54) FASTENING DEVICE AND LACE ASSEMBLING METHOD THEREOF

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 98 days.

This patent is subject to a terminal disclaimer.

(21) Appl. No.: 16/095,940

(22) PCT Filed: Nov. 11, 2016

(86) PCT No.: PCT/CN2016/105490

§ 371 (c)(1),
(2) Date: Oct. 23, 2018

(87) PCT Pub. No.: WO2018/086068

PCT Pub. Date: May 17, 2018

(65) Prior Publication Data

US 2019/0150569 A1 May 23, 2019

(51) Int. Cl.
*A43C 11/00* (2006.01)
*A43C 11/16* (2006.01)

(52) U.S. Cl.
CPC ..... *A43C 11/165* (2013.01); *A43C 11/00* (2013.01)

(58) Field of Classification Search
CPC ..... A43C 11/165; A43C 11/00; A43C 11/16; A43C 11/20; A43C 1/003; A43C 1/06; A43C 1/00
See application file for complete search history.

(56) References Cited

U.S. PATENT DOCUMENTS

| | | | | |
|---|---|---|---|---|
| 8,353,087 | B2 | 1/2013 | Chen | |
| 2008/0196224 | A1 | 8/2008 | Hu | |
| 2010/0139057 | A1 | 6/2010 | Soderberg et al. | |
| 2014/0359981 | A1* | 12/2014 | Cotterman | A43C 11/20 24/712.9 |
| 2015/0014463 | A1 | 1/2015 | Converse et al. | |
| 2015/0313319 | A1 | 11/2015 | Ha | |
| 2016/0058130 | A1 | 3/2016 | Boney et al. | |

FOREIGN PATENT DOCUMENTS

| | | | |
|---|---|---|---|
| CN | 201015448 | Y | 2/2008 |
| CN | 101843388 | A | 9/2010 |
| CN | 202218653 | U | 5/2012 |

(Continued)

*Primary Examiner* — Jack W Lavinder
(74) *Attorney, Agent, or Firm* — CKC & Partners Co., LLC

(57) ABSTRACT

A fastening device is provided. The fastening device is composed of a case, a spool, a knob and a locking unit. The case includes a mounted portion. The spool is disposed at the case and a lace is wound around the spool. The knob includes an engaged portion for engaging with the mounted portion such that the knob is coupled to the case. The locking unit is coupled to the knob and is driven by the knob. The locking unit is switched from a first position to a second position by rotating the knob relative to the case. When the locking unit is at the first position, the locking unit is coupled to the spool to prohibit the spool from rotating toward a loosening direction. When the locking unit is at the second position, the spool is allowed to be rotated toward the loosening direction.

13 Claims, 12 Drawing Sheets

(56) References Cited

FOREIGN PATENT DOCUMENTS

| | | | | |
|---|---|---|---|---|
| CN | 203492894 | U | 3/2014 | |
| CN | 104394730 | A | 3/2015 | |
| CN | 104839942 | A | 8/2015 | |
| CN | 204895922 | U | 12/2015 | |
| CN | 205267176 | U | 6/2016 | |
| CN | 205432385 | U | 8/2016 | |
| DE | 202011101828 | U1 * | 8/2011 | ..... A43C 7/00 |
| DE | 202016104318 | U1 | 11/2016 | |
| JP | H07208 | A | 1/1995 | |
| JP | 3202821 | U | 2/2016 | |
| JP | 2016-165490 | A | 9/2016 | |
| KR | 20100009337 | U | 9/2010 | |
| KR | 101040372 | B1 | 6/2011 | |
| KR | 101053551 | B1 | 8/2011 | |
| KR | 20130040141 | A | 4/2013 | |
| KR | 20150097389 | A | 8/2015 | |
| TW | 201127310 | A | 8/2011 | |
| TW | 201429420 | A | 8/2014 | |

* cited by examiner

700

FASTENING DEVICE AND LACE ASSEMBLING METHOD THEREOF

RELATED APPLICATIONS

This application is a continuation of International application No. PCT/CN2016/105490, filed Nov. 11, 2016, the content of which are incorporated herein by reference.

BACKGROUND

Technical Field

The present disclosure relates to a fastening device and a lace assembling method thereof. More particularly, the present disclosure relates to a fastening device and a lace assembling method thereof for securing an article through loosening or tightening a lace.

Description of Relative Art

In daily life, cords, such as a lace or a thread, are usually used to tighten articles. The most common tightening method is to use the cord to reciprocately pass through holes on the article, such as eyelets of a shoe, and then tie a knot to secure the article. But in this kind of tightening method, the knot is loosened easily because of an external force. Not only does the knot need to be tied again, but also lots of inconveniences come owning to the insecurity of the articles.

In order to solve such problems, some practitioners developed a simple fastening mechanism including a case, an engaging unit and a spring. The case includes holes to allow the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space to receive the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckles is complex; as a result, the manufacturing cost is increased, and the buckle has assembly and repair difficulty.

Base on the above-mentioned problems, how to simplify the structure of the fastening device, reduce the manufacturing cost and maintain the securing capability becomes a pursuit target for practitioners.

SUMMARY

Disclosure of Invention

The present disclosure provides a fastening device and a lace assembling method. Through the configuration of the fastening device, the structure thereof can be simplified while the securing capability of the fastening device is remained. Moreover, the lace can be coupled to the fastening device after the fastening device is assembled; hence, the convenient usage can be achieved.

According to one embodiment of the present disclosure, a fastening device which is for fastening and loosening a lace is provided. The fastening device is composed of a case, a spool, a knob and a locking unit. The case includes a mounted portion. The spool is disposed at the case and a lace is wound around the spool. The knob includes an engaged portion for engaging with the mounted portion such that the knob is coupled to the case. The locking unit is coupled to the knob and is driven by the knob. The locking unit is switched from a first position to a second position by rotating the knob relative to the case. When the locking unit is at the first position, the locking unit is coupled to the spool to prohibit the spool from rotating toward a loosening direction. When the locking unit is at the second position, the spool is allowed to be rotated toward the loosening direction.

Therefore, the fastening device is composed of the case, the spool, the knob and the locking unit, and through engagement between the case and the knob, a conventional cupper post or a plastic post which is configured for passing through the case to connect to the knob can be omitted. The structure of the fastening device is simplified and the securing capability of the fastening device is maintained.

According to the abovementioned fastening device, the locking unit can include a ring body, a first retaining portion and a second retaining portion. The ring body has a radial direction. The first retaining portion and the second retaining portion are disposed at the ring body and are coupled to the knob. Each of the first retaining portion and the second retaining portion has a restoring capability in the radial direction. The locking unit can further include a pawl arm disposed at the ring body, and the case includes a plurality of inner teeth. When the locking unit is at the first position, the pawl is engaged with the inner teeth to prohibit the spool from rotating toward the loosening direction, and the pawl is disengaged with the inner teeth in a tightening direction which is opposite to the loosening direction. Or the locking unit can further include a pawl arm disposed at the ring body. The pawl arm can extend outwardly from the ring body in the radial direction, and the first retaining portion and the second retaining portion extend inwardly from the ring body in the radial direction.

According to the abovementioned fastening device, the knob can further include two protrusions coupled to the first retaining portion and the second retaining portion, respectively, and when the locking unit is driven by the knob to be switched from the first position to the second position, the first retaining portion and the second retaining portion are pushed by the protrusions, respectively, to move in the redial direction. The case can include a housing which includes a lower opening and two side holes. The spool includes a spool cylinder and a bottom. The spool cylinder includes a first opening and a second opening. The bottom for disposing the spool cylinder includes a first knotting hole, a first through hole, a second knotting hole and a second through hole. The first knotting hole and the first through hole are communicated with the first opening, and the second knotting hole and the second through hole are communicated with the second opening. A first end of the lace is exposed from the lower opening after passing through one of the side holes, the first opening, the first knotting hole and the first through hole, and a second end of the lace is exposed from the lowing opening after passing through the other one of the side holes, the second opening, the second knotting hole and the second through hole.

According to another embodiment of the present disclosure, a fastening device which is for fastening and loosening a lace is provided. The fastening device is composed of a case, a spool, a knob and a locking unit. The case includes a housing and a base. The housing includes a mounted portion, and the base is for disposing the housing. The spool is disposed at the case and a lace is wound around the spool. The knob is disposed at the housing and includes an inner wall, an engaged portion and a spiral track. The engaged portion is disposed at the inner wall and is engaged with the mounted portion such that the knob is coupled to the housing. The spiral track is disposed at the inner wall. The locking unit is coupled to the knob and the locking unit includes a guiding portion coupled to the spiral track so as to be driven by the knob. The locking unit is switched from a first position to a second position by rotating the knob relative to the case to allow the guiding portion to be limitedly moved along the spiral track. When the locking unit is at the first position, the locking unit is coupled to the spool to prohibit the spool from rotating toward a loosening direction, and when the locking unit is at the second position, the spool is allowed to be rotated toward the loosening direction.

According to the abovementioned fastening device, the locking unit can include a ring body, a first retaining portion and a second retaining portion. The ring body has a radial direction. The first retaining portion and the second retaining portion are disposed at the ring body and are coupled to the knob. Each of the first retaining portion and the second retaining portion has restoring capability in the radial direction. The locking unit can further include a pawl disposed at the ring body. The pawl extends outwardly from the ring body in the radial direction to detachably engage with a plurality of inner teeth of the housing, and the first retaining portion and the second retaining portion extend inwardly from the ring body in the radial direction to detachably engage with two protrusions of the knob, respectively. The housing can include a lower opening and two side holes. The spool includes a spool cylinder and a bottom. The spool cylinder includes a first opening and a second opening. The bottom for disposing the spool cylinder includes a first knotting hole, a first through hole, a second knotting hole and a second through hole. The first knotting hole and the first through hole are communicated with the first opening, and the second knotting hole and the second through hole are communicated with the second opening. A first end of the lace is exposed from the lower opening after passing through one of the side holes, the first opening, the first knotting hole and the first through hole, and a second end of the lace is exposed from the lower opening after passing through the other one of the side holes, the second opening, the second knotting hole and the second through hole.

According to yet another embodiment of the present disclosure, a lace assembling method which is for connecting the lace to the fastening device is provided. The lace assembling method includes: providing a fastening device, the fastening device being composed of a case, a spool, a knob and a locking unit, the case including a housing, the housing including a mounted portion, the knob including an engaged portion for engaging with the mounted portion, the spool being disposed inside the housing, the locking unit is coupled to the spool and the knob; and providing a lace coupling process, a first end of the lace and a second end of the lace being exposed from the case after passing through the case and the spool, such that a user knot the first end and the second end to allow the lace to be coupled to the spool.

According to the abovementioned lace assembling method, the case can further include two side holes and a lower opening. The spool includes a spool cylinder and a bottom. The spool cylinder includes a first opening and a second opening, and the bottom is for disposing the spool cylinder and includes a first knotting hole, a first through hole, a second knotting hole and a second through hole. The first knotting hole and the first through hole are communicated with the first opening. The second knotting hole and the second through hole are communicated with the second opening. In the lacing coupling process, the first end of the lace is exposed from the lower opening after passing through one of the side holes, the first opening, the first knotting hole and the first through hole to allow being knotted by the user, and the second end of the lace is exposed from the lower opening after passing through the other one of the side holes, the second opening, the second knotting hole and the second through hole to allow being knotted by the user.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

Figure 1:
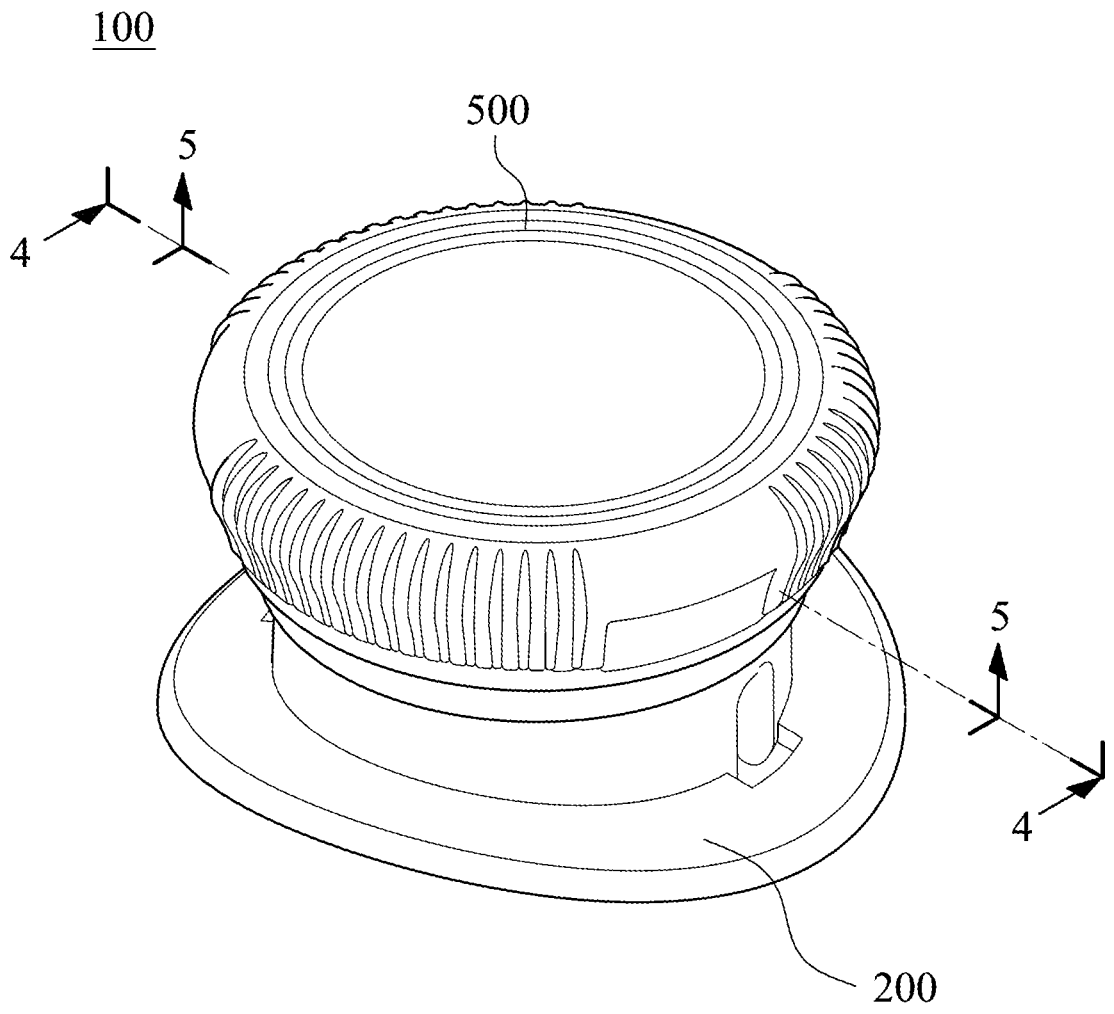
FIG. 1 shows a three dimensional schematic view of a fastening device according to one embodiment of the present disclosure.
Figure 2A:
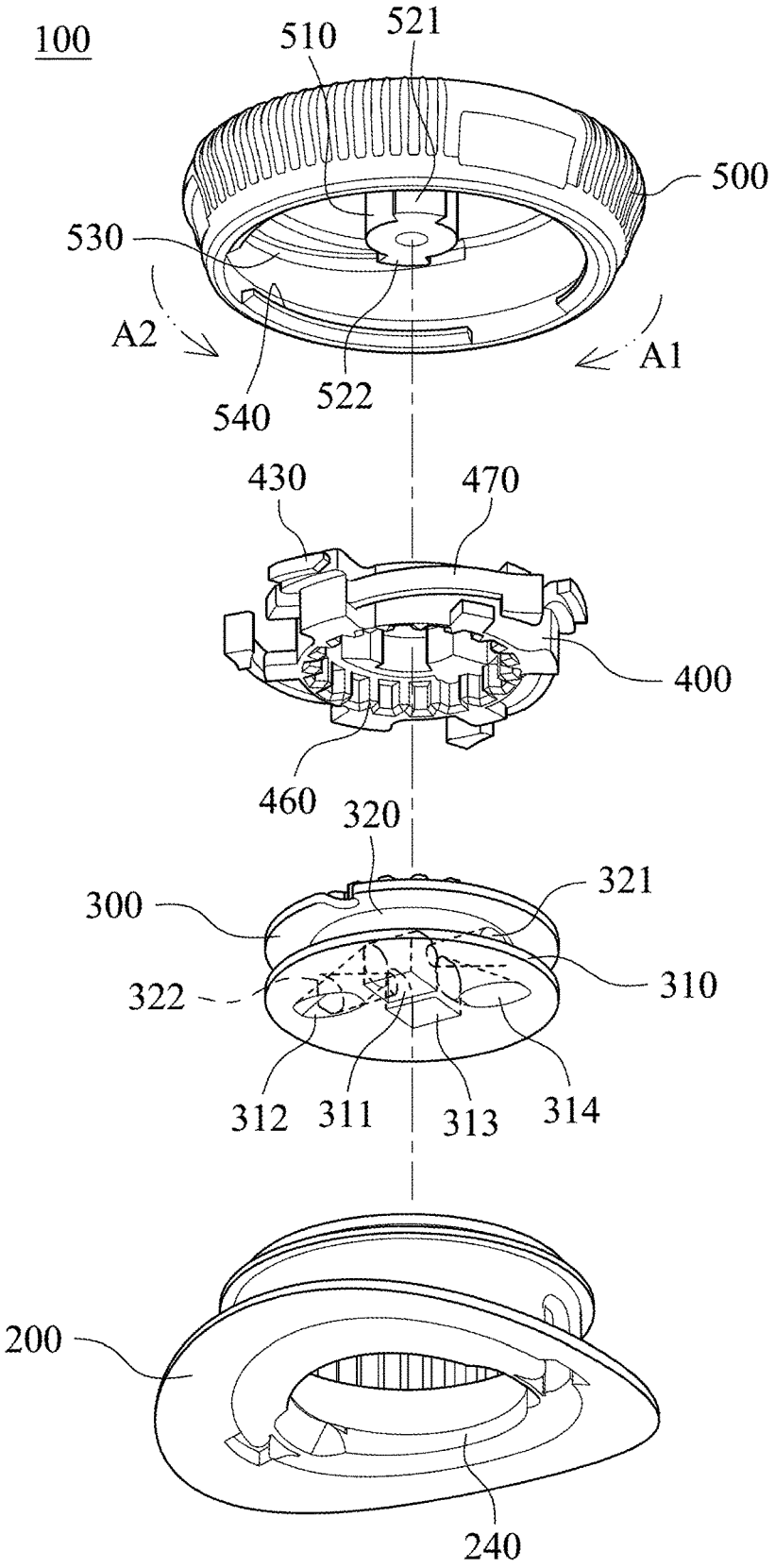
FIG. 2A shows one exploded view of the fastening device of FIG. 1.
Figure 2B:
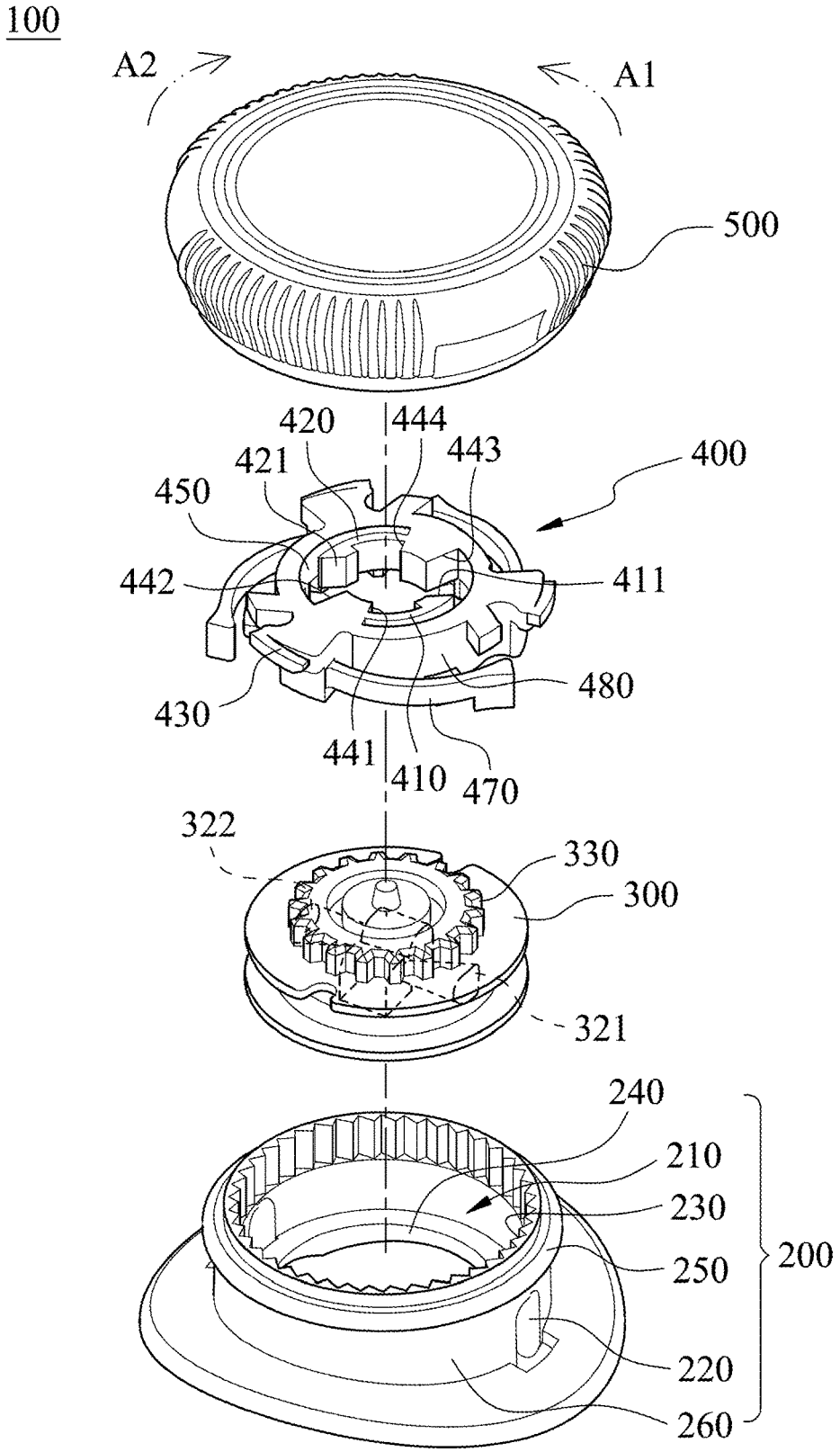
FIG. 2B shows another exploded view of the fastening device of FIG. 1.

Please refer to FIG. 1, FIG. 2A and FIG. 2B, wherein FIG. 1 shows a three dimensional schematic view of a fastening device 100 according to one embodiment of the present disclosure, FIG. 2A shows one exploded view of the fastening device 100 of FIG. 1, and FIG. 2B shows another exploded view of the fastening device 100 of FIG. 1.

The fastening device 100 which is for fastening and loosening a lace 600 is composed of a case 200, a spool 300, a knob 500 and a locking unit 400, wherein the case 200 includes a mounted portion 250; the spool 300 is disposed at the case 200 and a lace 600 is wound therearound; the knob 500 includes an engaged portion 540 for engaging with the mounted portion 250, such that the knob 500 is coupled to the case 200; the locking unit 400 is coupled to the knob 500 and is driven by the knob 500, the locking unit 400 is switched from a first position to a second position by rotating the knob 500 relative to the case 200, the locking unit 400 is coupled to the spool 300 to prohibit the spool 300 from rotating toward a loosening direction A1 when the locking unit 400 is at the first position, and the spool 300 is allowed to be rotated toward the loosening direction A1 when the locking unit 400 is at the second position.

Therefore, since the fastening device 100 is composed of the case 200, the spool 300, the knob 500 and the locking unit 400, through the engaging relationship between the case 200 and the knob 500, the structure of the fastening device 100 can be simplified while the securing capability of the fastening device 100 is remained. The detail structure and operation of the fastening device 100 will be described in the following paragraphs.

The case 200 has a hollow structure, and includes a housing 260, the housing 260 includes a receiving space 210, a plurality of inner teeth 230, two side holes 220 and a lower opening 240. The inner teeth 230 face to the receiving space 210, the two side holes 220 and the lower opening 240 are communicated with the receiving space 210, and the mounted portion 250 is protruded outwardly from the housing and is ring-shaped. In the embodiment, a diameter of the lower opening 240 is smaller than a diameter of the spool 300, and after the spool 300 is disposed inside the receiving space 210 of the housing 260, it will not fall out from the lower opening 240.

The spool 300 is disc-shaped, and includes a spool cylinder 320 and a bottom 310, the spool cylinder 320 includes a first opening 321 and a second opening 322, the bottom 310 is for disposing the spool cylinder 320, the bottom 310 includes a first knotting hole 311, a first through hole 312, a second knotting hole 313 and a second through hole 314, the first knotting hole 311 and the first through hole 312 are communicated with the first opening 321, and the second knotting hole 313 and the second through hole 314 are communicated with the second opening 322. A first end and a second end of the lace 600 can pass through the first opening 321 and the second opening 322, respectively, to couple with the spool 300, such that the lace 600 can be wound around the spool cylinder 320. In addition, the spool 300 can further include a plurality of engaging teeth 330 for engaging with the locking unit 400.

The locking unit 400 includes a ring body 480, a first retaining portion 410, a second retaining portion 420, three guiding portions 430, four stopping portions 441, 442, 443, 444, a communicated hole 450, a plurality of engaged teeth 460 and three pawl arms 470. The ring body 480 has a radial direction, the first retaining portion 410 and the second retaining portion 420 are disposed at the ring body 480 and are coupled to the knob 500, the guiding portions 430 having inclined block structure are protruded outwardly from the ring body 480 along the radial direction and are used for coupling to the knob 500, the pawl arms 470 are disposed at the ring body 480, which are protruded outwardly from the ring body 480 along the radial direction and are for used coupling to the inner teeth 230, and the first retaining portion 410 and the second retaining portion 420 are protruded inwardly along the radial direction, that is, protruded toward a center of the ring body 480. The engaged teeth 460 are disposed at a distal end of a wall of the communicated hole 450, which is close to the spool 300, and the four stopping portions 441, 442, 443, 444 are protruded toward the center from a proximal end of the wall of the communicated hole 450, which is close to the knob 500, the stopping portions 441, 443 are corresponding to each other, and the stopping portions 442, 444 are corresponding to each other.

Each of the first retaining portion 410 and the second retaining portion 420 has restoring capability in the radial direction, precisely, the first retaining portion 410 has a first free end 411, the second retaining portion 420 has a second free end 421, when each of the first free end 411 and the second free end 421 bears a force applied thereon being larger than the force they can bear, they would be deformed in the radial direction, and when the external force is removed, the first free end 411 and the second free end 421 restore.

In addition to the engaged portion 540, the knob 500 further includes a protruding cylinder 510, two protrusions 521, 522 (shown in FIG. 2A) and a spiral track 530. The protruding cylinder 510 is protruded toward the locking unit 400, the two protrusions 521, 522 are positioned at the protruding cylinder 510 and are corresponding to each other, the protruding cylinder 510 and the protrusions 521, 522 are protruded into the communicated hole 450 when assembling, such that when the locking unit 400 is at the first position, the protrusion 521 is abutted against the first retaining portion 410, and the second protrusion 522 is abutted against the second retaining portion 420. The spiral track 530 is disposed at an inner wall (not labeled) of the knob 500 for coupling to the guiding portions 430, the engaged portion 540 is also disposed at the inner wall, and has a groove structure corresponding to the mounted portion 250.

Figure 3A:
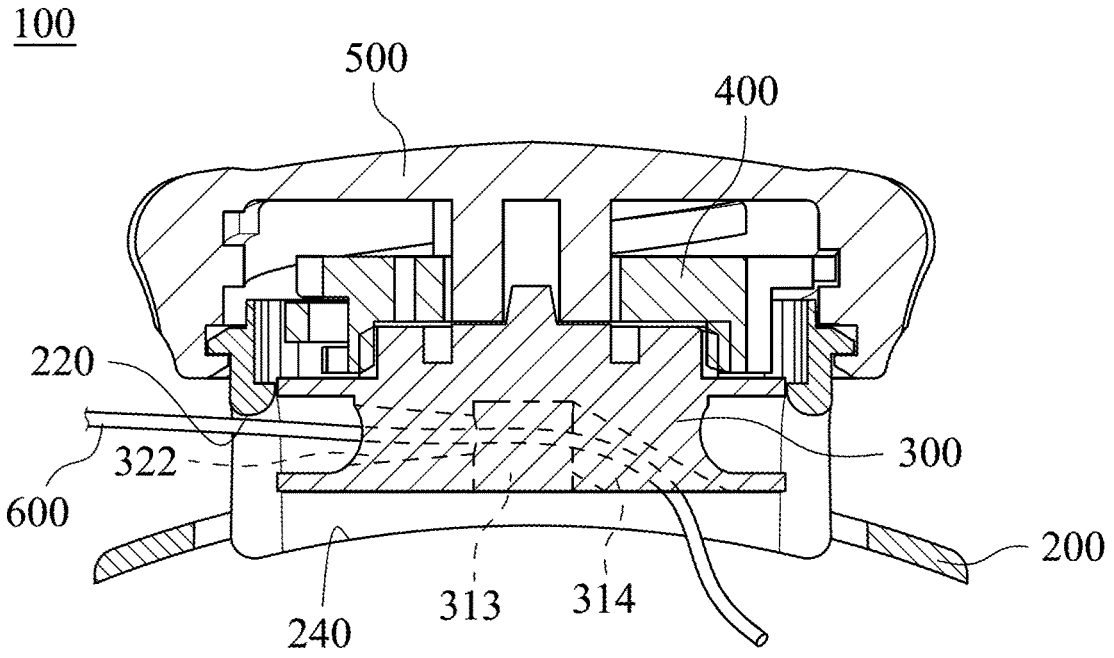
FIGS. 3A to 3C show illustrations of a lace coupling process for the lace of the fastening device of FIG. 1.
Figure 3B:
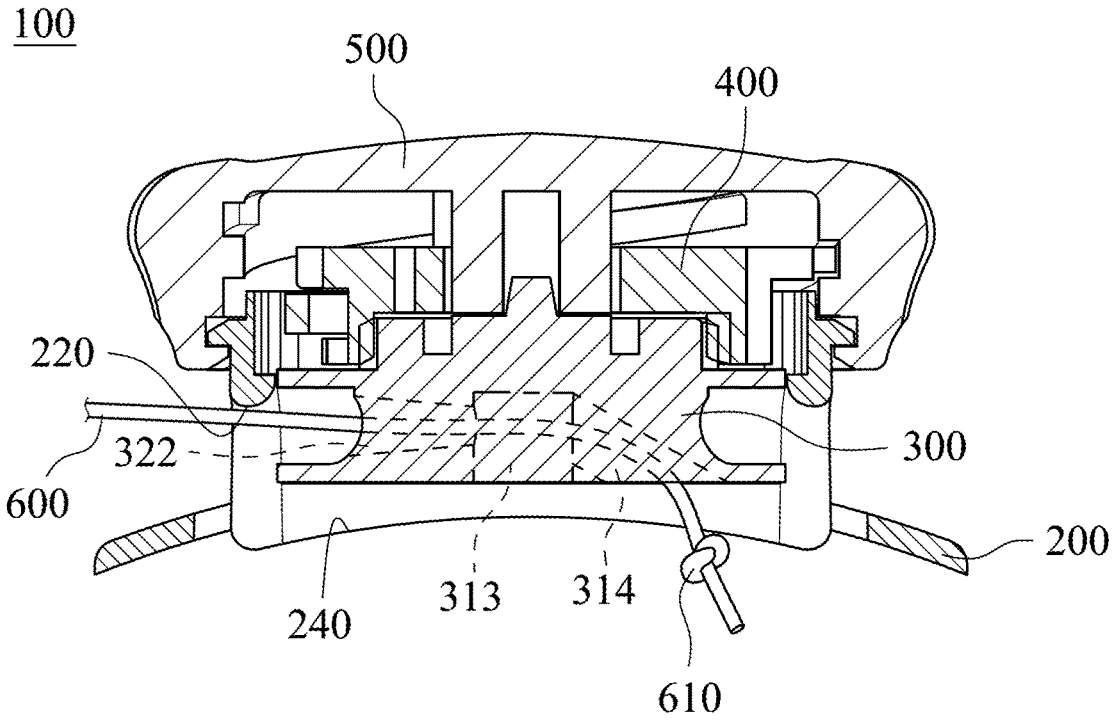
Figure 3C:
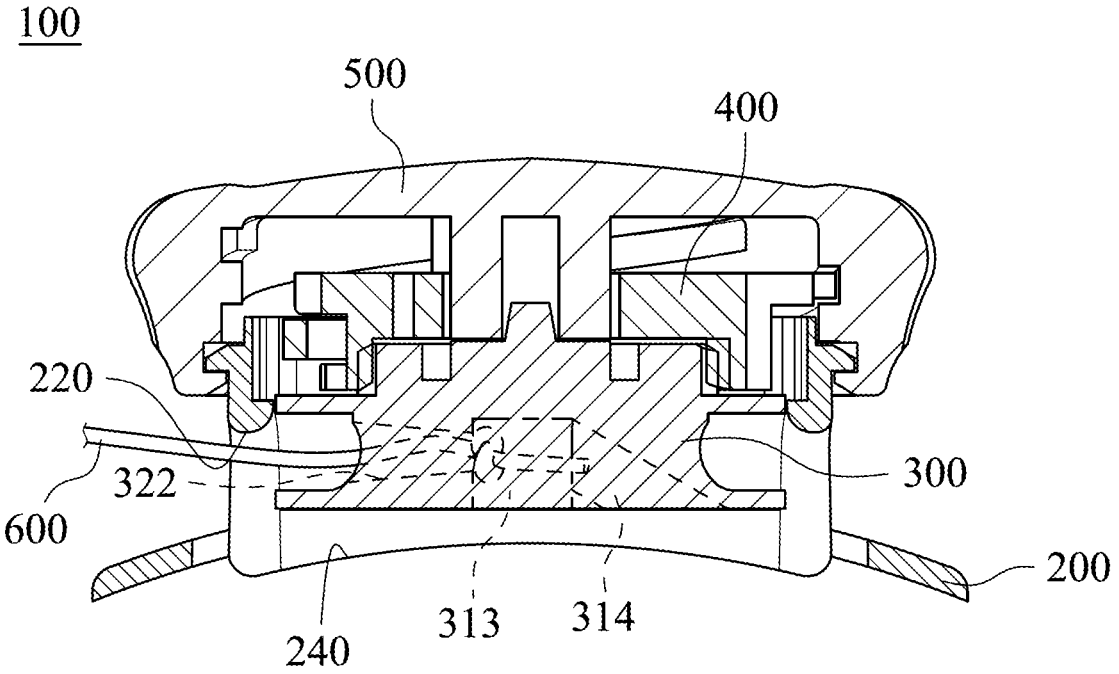

Please refer to FIGS. 3A to 3C, wherein FIGS. 3A to 3C show illustrations of a lace coupling process for the lace 600 of the fastening device 100 of FIG. 1. When assembling the fastening device 100, the spool 300 can be disposed inside the case 200 first, and after the knob 500 is assembled with the locking unit 400, the knob 500 can be covered on the case 200, finally a force can be applied to engage the engaged portion 540 of the knob 500 with the mounted portion 250 of the case 200, such that assembly of the fastening device 100 can be completed.

When the lace 600 is going to be coupled to the spool 300, as shown in FIG. 3A, the second end (not labeled) of the lace 600 can be passed through one of the side holes 220, the second opening 322, the second knotting hole 313 and the second through hole 314, such that the second end is exposed from the lower opening 240. As shown in FIG. 3B, a user (not shown) can tie the second end into a knot 610 and a tail (not labeled), and as shown in FIG. 3C, the lace 600 can be pulled from the second opening 322 by the user, such that the knot 610 can be moved into the second knotting hole 313 so as to be limited in the second knotting hole 313, the tail is left in the second through hole 314, and will not be exposed from the lower opening 240.

Similarly, the first end of the lace 600 (which is opposite to the second end) can be passed through the other one of the side holes 220, the first opening 321, the first knotting hole 311 and the first through hole 312 such that the first end is exposed from the lower opening 240, the user can tie the first end into another knot and another tail (not shown), then the knot can be limited in the first knotting hole 311, and the tail can be left in the first through hole 312.

Figure 4A:
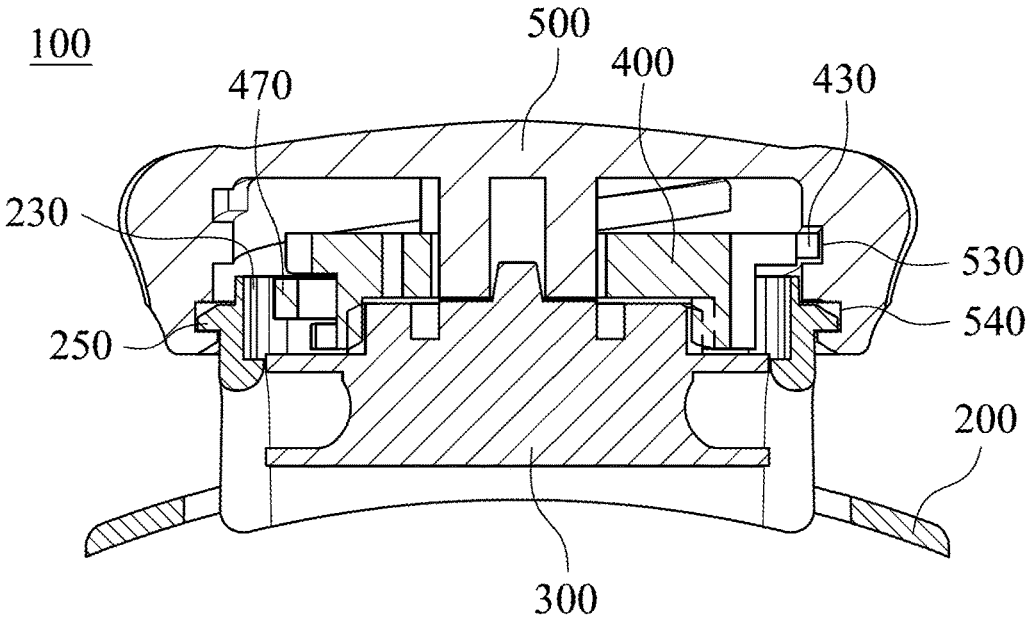
FIG. 4A shows one cross-sectional view of the fastening device of FIG. 1 taken along Line 4-4.
Figure 4B:
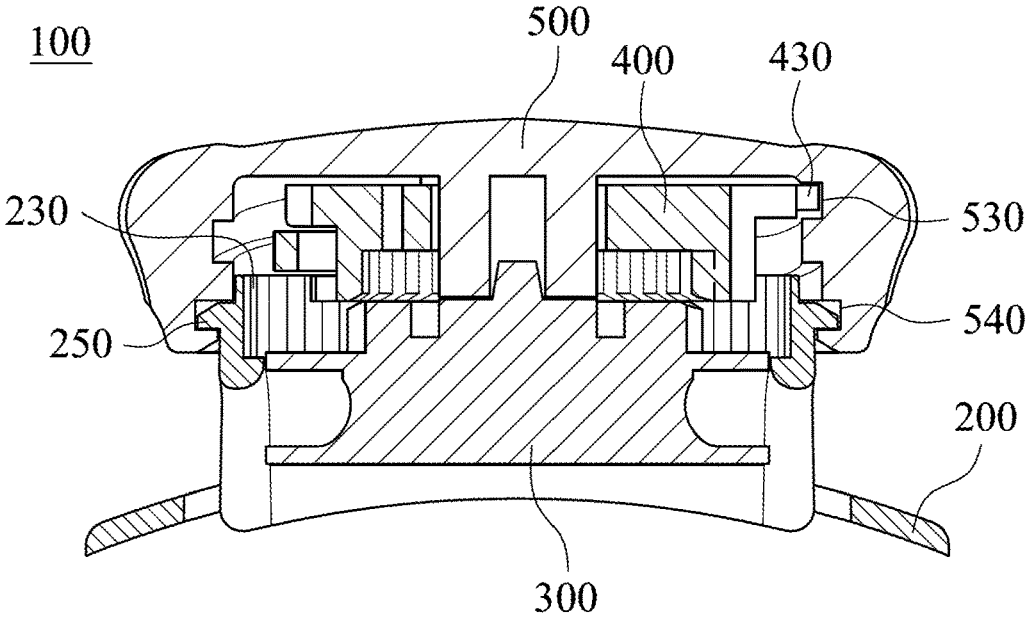
FIG. 4B shows another cross-sectional view of the fastening device of FIG. 1 taken along Line 4-4.

Please refer to FIG. 4A and FIG. 4B, and also refer to FIGS. 2A and 2B together, wherein FIG. 4A shows one cross-sectional view of the fastening device 100 of FIG. 1 taken along Line 4-4, and FIG. 4B shows another cross-sectional view of the fastening device 100 of FIG. 1 taken along Line 4-4.

As shown in FIG. 4A, the guiding portions 430 (shown in FIG. 2B) can be limitedly moved along the spiral track 530 (shown in FIG. 2A), that is, when the knob 500 is rotated relative to the locking unit 400, the guiding portions 430 are moved along the spiral track 530, such that the locking unit 400 is lifted or lowered relative to the knob 500. As shown in FIG. 3A, when the locking unit 400 is at the first position, the pawl arms 470 (shown in FIG. 2B) are coordinated with the inner teeth 230 (shown in FIG. 2B), and the engaged teeth 460 (shown in FIG. 2A) are engaged with the engaging teeth 330 (shown in FIG. 2B), the pawl arms 470 are disengaged with the inner teeth 230 in the tightening direction A2 (shown in FIG. 2B) while engaged with the inner teeth 230 in the loosening direction A1 (shown in FIG. 2B) owing to the structure thereof; as a result, when the knob 500 is rotated toward the tightening direction A2 to drive the locking unit 400, the spool 300 linked up therewith can retract the lace 600, when the knob 500 is stopped, the pawl arms 470 are engaged with the inner teeth 230 to prohibit the spool 300 from rotating toward the loosening direction A1, and a securing purpose can be achieved.

As shown in FIG. 4B, the locking unit 400 is at the second position when the knob 500 is rotated toward the loosening direction A1 to move the guiding portions 430, since the pawl arms 470 are not engaged with the inner teeth 230, the spool 300 can free rotate toward the loosening direction A1, hence, the lace 600 can be pulled out to achieve a releasing purpose. In the embodiment, the engaged teeth 460 are disengaged with the engaging teeth 330 to allow the locking unit 400 to be disengaged with the spool 300 when the locking unit 400 is at the second position, but in other embodiment, the engaged teeth 460 and the engaging teeth 330 can be engaged at the second position, while the pawl arms 470 are disengaged with the inner teeth 230, or the pawl arms 470 are engaged with the inner teeth 230 at the second position, while the engaged teeth 460 are disengaged with the engaging teeth 330, and will not be limited thereto.

Figure 5A:
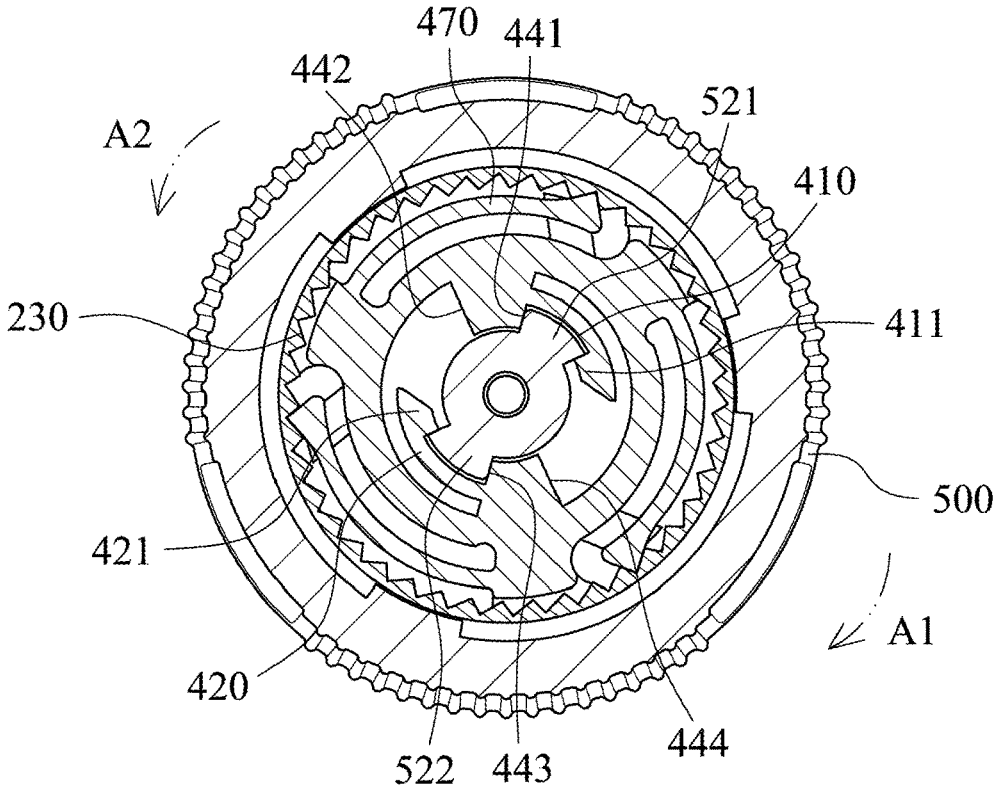
FIG. 5A shows one cross-sectional view of the fastening device of FIG. 1 taken along Line 5-5.
Figure 5B:
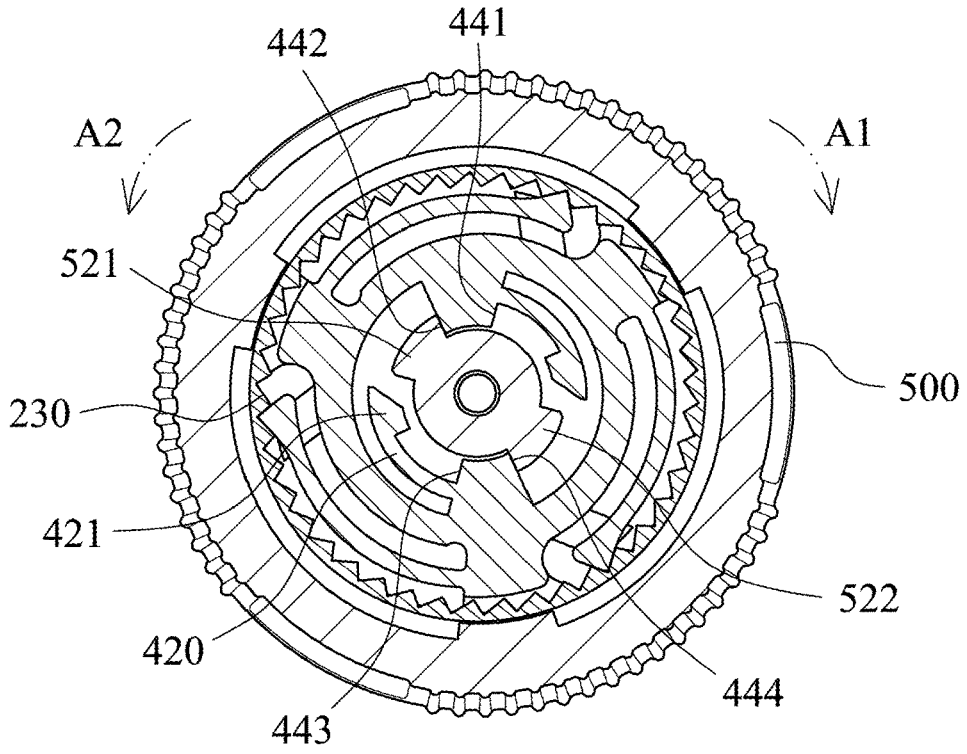
FIG. 5B shows another cross-sectional view of the fastening device of FIG. 1 taken along Line 5-5.

Please refer to FIG. 5A and FIG. 5B, wherein FIG. 5A shows one cross-sectional view of the fastening device 100 of FIG. 1 taken along Line 5-5, and FIG. 5B shows another cross-sectional view of the fastening device 100 of FIG. 1 taken along Line 5-5.

As shown in FIG. 5A, the locking unit 400 is at the first position, the protrusion 521 is abutted against the first retaining portion 410 and the stopping portion 441, the protrusion 522 is abutted against the second retaining portion 420 and the stopping portion 443, thus the knob 500 (shown in FIG. 2A) is engaged with the locking unit 400, and when the knob 500 is rotated toward the tightening direction A2, the protrusion 521 presses the stopping portion 441, the protrusion 522 presses the stopping unit 443, such that the locking unit 400 is driven to rotate. On the other hand, when the knob 500 is stopped, owning to the configuration of the first retaining portion 410 and the second retaining portion 420, the protrusion 521 and the protrusion 522 can be abutted for maintaining the relative position of the knob 500 and the locking unit 400, such that it is favorable for preventing the position of the knob 500 and the engaging unit 400 from being moved by the external force (which is a vibrating force in the environment during using, not the force applied by the user) to lead the lace 600 to be released.

When the knob 500 is rotated toward the loosening direction A1, because of the engagement between the pawl arms 470 and the inner teeth 230, the locking unit 400 cannot be rotated, thus the protrusion 521 presses the first free end 411 of the first retaining portion 410 when forced, the protrusion 522 presses the second free end 421 of the second retaining portion 420 when forced, the first free end 411 and the second free end 421 are deformed to move along the radial direction because they can no bear the force, and as shown in FIG. 5B, when the knob 500 is rotated relative to the locking unit 400, the protrusion 521 is abutted against the stopping portion 444 and the protrusion 522 is abutted against the topping portion 442, the first free end 411 and the second free end 421 restore after the force eliminated. Hence, when the knob 500 is rotated relative to the locking unit 400, the guiding portions 430 are moved along the spiral track 530, and the locking unit 400 is driven to change from the first position to the second position.

In addition, if the knob 500 is rotated toward the tightening direction A2 again, the protrusion 521 will touch the first free end 411 first and then press the first free end 411, the protrusion 522 will tough the second free end 421 first and then press the second free end 421, because the locking unit 400 is lowered to a position between the first position and the second position, the pawl arms 470 are engaged with the inner teeth 230, and before the pawl arms 470 are disengaged with the inner teeth 230 in the tightening direction A2, the pawl arms 470 must be deformed in the radial direction. The first free end 411 and the second free end 421 have to be deformed along the radial direction to allow the locking unit 400 to be switched to the first position in the configuration.

In other embodiment, the structures of the first retaining portion 410 and the second retaining portion 420 can be changed, the retaining portion can couple to the knob, or coupled to the case, only when it has a capability to maintain the relative position of the knob and the locking unit to prohibit the locking unit from being lifted or lowered under a certain force, and the number of the retaining portion and the number of the mounted portion are no limited.

Figure 6:
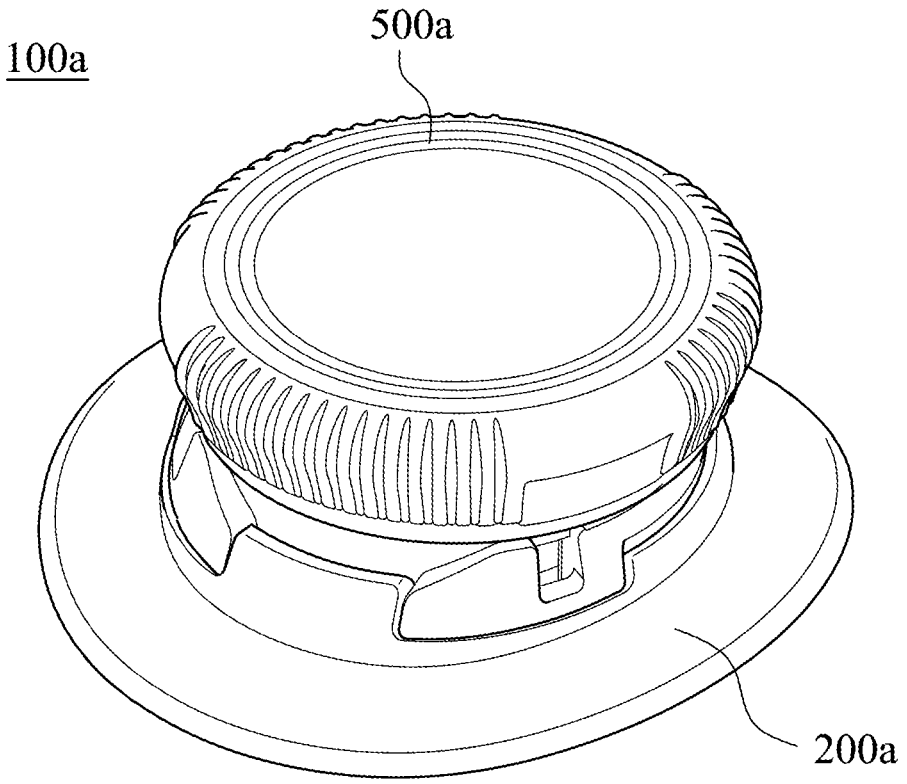
FIG. 6 shows a three dimensional schematic view of a fastening device according to another embodiment of the present disclosure.
Figure 7A:
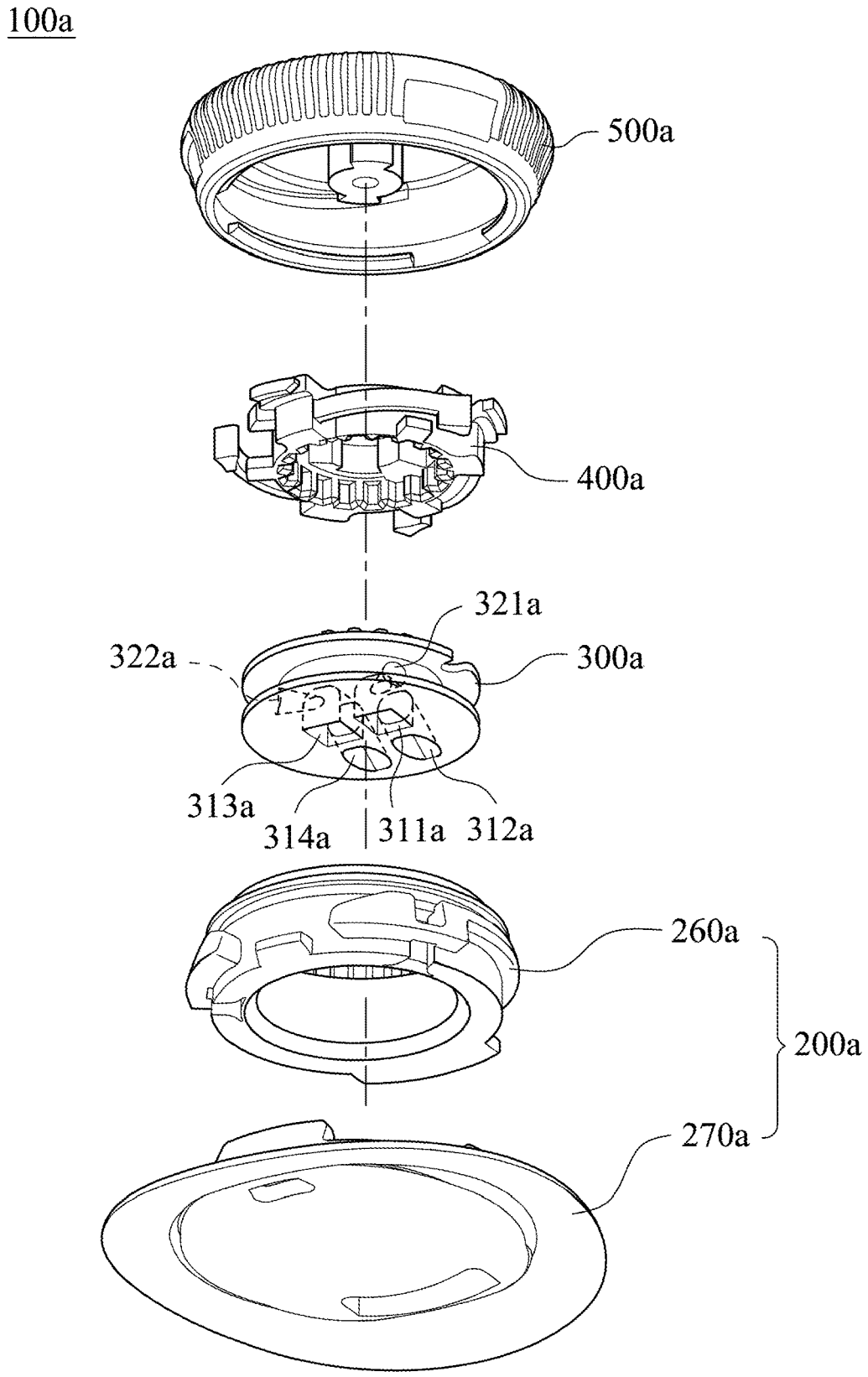
FIG. 7A shows one exploded view of the fastening device of FIG. 6.
Figure 7B:
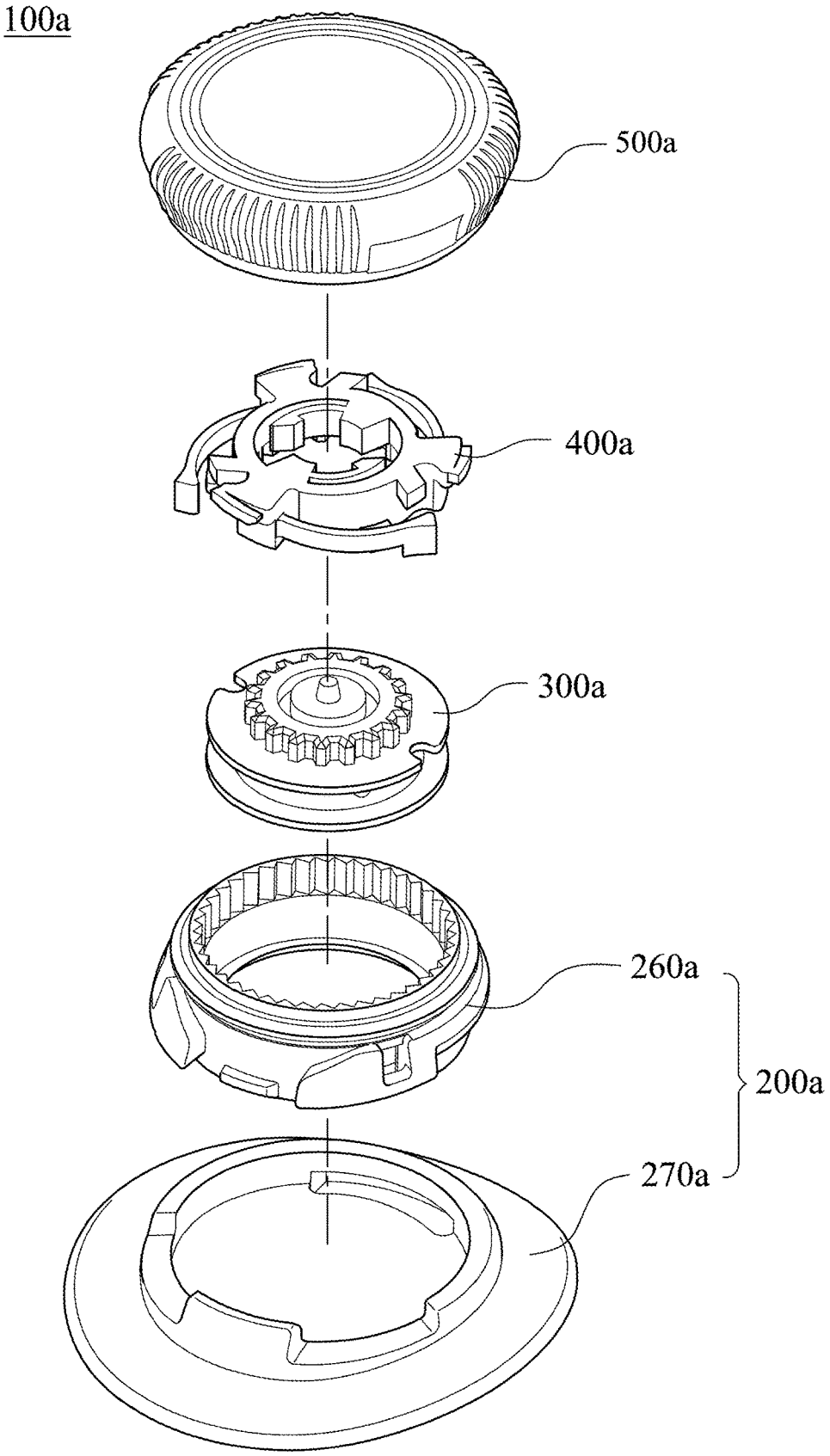
FIG. 7B shows another exploded view of the fastening device of FIG. 6.

Please refer to FIG. 6, FIG. 7A and FIG. 7B, wherein FIG. 6 shows a three dimensional schematic view of a fastening device 100*a* according to another embodiment of the present disclosure, FIG. 7A shows one exploded view of the fastening device 100*a* of FIG. 6, and FIG. 7B shows another exploded view of the fastening device 100*a* of FIG. 6.

The fastening device 100*a* is for loosening and tightening a lace (not shown) and is composed of a case 200*a*, a spool 300*a*, a knob 500*a* and a locking unit 400*a*, the structures and operations of the case 200*a*, the spool 300*a*, the knob 500*a* and the locking unit 400*a* are similar to the structures of the case 200, the spool 300, the knob 500 and the locking unit 400 of FIGS. 1 to 5B, but the difference is, the relationships between the first opening 321*a*, the second opening 322*a*, the first knotting hole 311*a*, the first through hole 312*a*, the second knotting hole 313*a* and the second through hole 314*a* of the spool 300*a* being different from the relationships between the first opening 321, the second opening 322, the first knotting hole 311, the first through hole 312, the second knotting hole 313 and the second through hole 314. Precisely, the lace of the embodiment is coupled to the spool 300*a* with an angle of 60 degrees, and the lace of the embodiment of FIG. 1 is couple to the spool 300 with an angle of 180 degrees.

Additionally, in the embodiment, the case 200*a* can further include a base 270*a* in addition to the housing 260*a*, after coupling the lace to the spool 300*a* as shown in FIGS. 3A to 3C, the base 270*a* can coupled to the housing 260*a*, serving as a protection function.

Figure 8A:
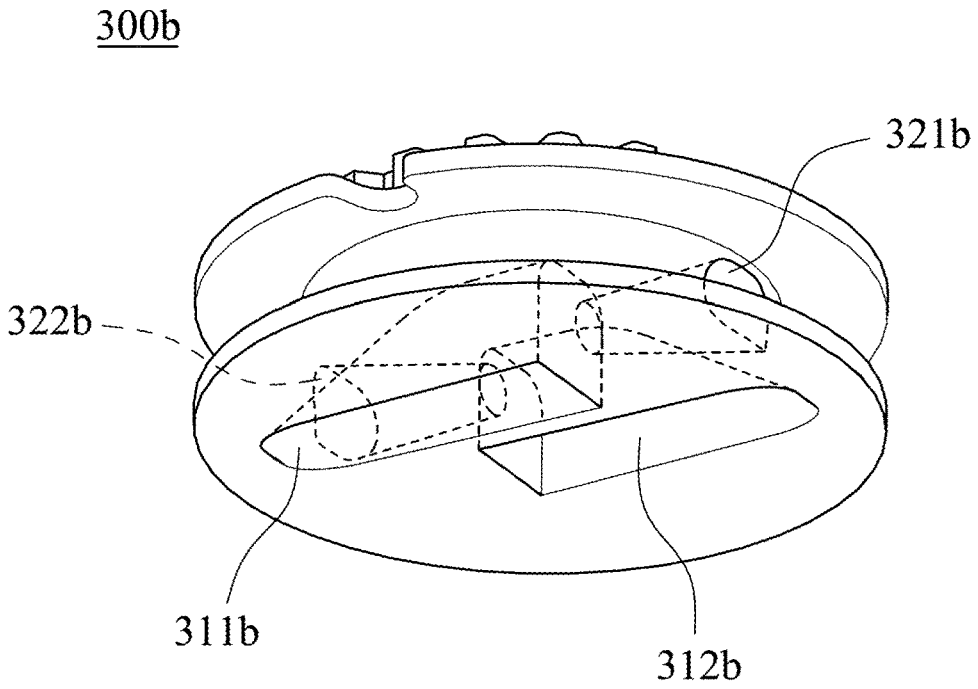
FIG. 8A shows a three dimensional schematic view of a spool of a fastening device according to yet another embodiment of the present disclosure.
Figure 8B:
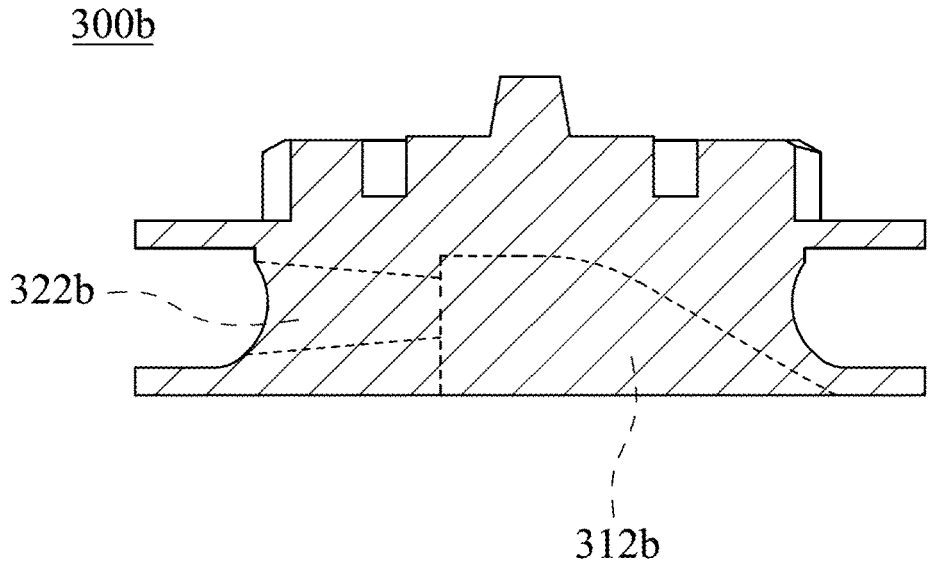
FIG. 8B shows a cross-sectional view of the spool of FIG. 8A.

Please refer to FIG. 8A and FIG. 8B, wherein FIG. 8A shows a three dimensional schematic view of a spool 300*b* of a fastening device according to yet another embodiment of the present disclosure, and FIG. 8B shows a cross-sectional view of the spool 300*b* of FIG. 8B. In the embodiment, the basic structure of the fastening device is similar to the structure of the fastening device 100*a*, but the structure of the spool 300*a* is different, thus only the spool 300*b* is shown, while the other elements of the fastening device are omitted.

The spool 300*b* is disc-shaped, and includes a spool cylinder (not labeled) and a bottom (not labeled), the spool cylinder includes a first opening 321*b* and a second opening 322*b*, the bottom is for disposing the spool cylinder, and the bottom includes a first passing hole 311*b* and a second passing hole 312*b*, the first passing hole 311*b* is communicated with the first opening 321*b*, and the second opening 322*b* is communicated with the second passing hole 312*b*.

A first end (not shown) of the lace can be passed through one of the side holes, the first opening 321*b* and the first passing hole 311*b* so as to be exposed from the lower opening of the case, the user can tie the first end exposed from the lower opening into a knot and a tail, and then the knot and the tail can be limited in the first passing hole 311*b*; similarly, a second end of the lace can be passed through the other one of the side holes, the second opening 322*b* and the second passing hole 312*b* so as to be exposed from the lower opening of the case, the user can tie the second end exposed from the lower opening into another knot and another tail, and then the knot and the tail can be limited in the second passing hole 312*b*.

Figure 9:
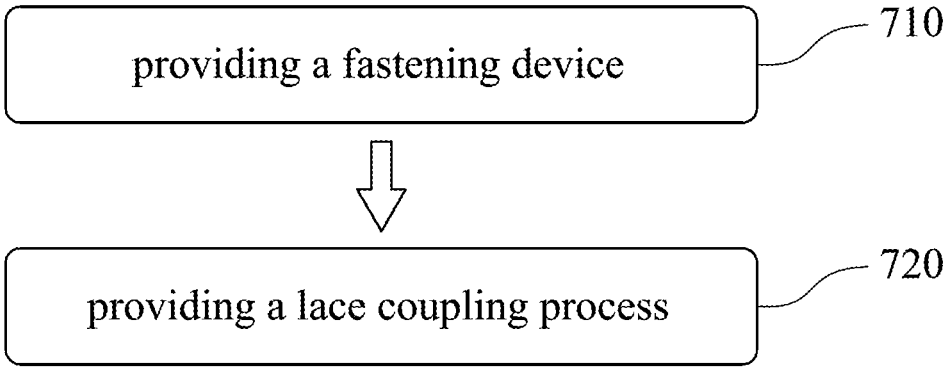
FIG. 9 shows a flow chart of a lace assembling method according to still yet another embodiment of the present disclosure.

Please refer to FIG. 9, and also refer to FIGS. 1 to 3C, wherein FIG. 9 shows a flow chart of a lace assembling method 700 according to still yet another embodiment of the present disclosure. The lace assembling method 700 includes Step 710 and Step 720.

In Step 710, a fastening device 100 is provided, as shown in FIGS. 1 to 2A, the fastening device 100 is composed of the case 200, the spool 300, the knob 500 and the locking unit 400, the case 200 includes the housing 260, the housing 260 includes the mounted portion 250, the knob 500 includes the engaged portion 540 for engaging with the mounted portion 250, the spool 300 is disposed inside the housing 260, and the locking unit 400 is coupled to the spool 300 and the knob 500.

In Step 720, a lacing coupling process is provided. As shown in FIGS. 3A to 3C, the first end of the lace 600 and a second end of the lace 600 are exposed from the case 200 after passing through the case 200 and the spool 300, such that a user can knot the lace 600 to allow the lace to be coupled to the spool 300. Precisely, in the lace coupling process, the first end of the lace 600 is exposed from the lowering opening 240 after passing through one of the side holes 220, the first opening 321, the first knotting hole 311 and the first through hole 312 to allow being knotted by the user, the second end of the lace 600 is exposed from the lowering opening 240 after passing through the other one of the side holes 220, the second opening 322, the second knotting hole 313 and the second through hole 314 to allow being knotted by the user, and the lace 600 can be coupled to the fastening device 100.

Through the abovementioned embodiment, the present disclosure has advantages as follows.

1. Since the fastening device is composed of the case, the spool, the knob and the locking unit, through the engagement between the case and the knob, a conventional cupper post or plastic post which is configured for passing through the case to connect to the knob can be omitted, and the structure of the fastening device can be simplified while maintaining the securing capability.

2. Through the structure configuration of the lower opening and the spool, the lace can be coupled to the spool after the fastening device is assembled, the manufacturing process is simplified, and the user can couple the lace to the fastening device after threading the lace through the holes of the articles, such that the using convenience is increased.

3. Through the configuration of the guiding portion and the spiral track, the locking unit can change position when the knob is rotated; thus the tension state or loose state can be changed.

4. Through the configuration of the first retaining portion and the second retaining portion, the relative position of the knob and the locking unit at the first position or the second position can be maintained, and loose of the lace owing to the environment force can be prevented.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, which is for fastening and loosening a lace, the fastening device composed of a case, a spool, a knob and a locking unit, wherein:

the case comprises a mounted portion;

the spool is disposed at the case, and a lace is wound around the spool;

the knob comprises an engaged portion for engaging with the mounted portion, such that the knob is coupled to the case, wherein the knob has an inner wall and the engaged portion is disposed at the inner wall, and the engaged portion is engaged with the mounted portion to couple the knob to the case; and the locking unit is coupled to the knob and is driven by the knob;

rotating the knob relative to the case allows the locking unit to be driven to switch from a first position to a second position, the locking unit is coupled to the spool to prohibit the spool from rotating toward a loosening direction when the locking unit is at the first position, and the spool is allowed to be rotated toward the loosening direction when the locking unit is at the second position.

2. The fastening device of claim 1, wherein the locking unit comprises:

a ring body, having a radial direction; and a first retaining portion and a second retaining portion, disposed at the ring body and coupled to the knob, each of the first retaining portion and the second retaining portion has restoring capability in the redial direction.

3. The fastening device of claim 2, wherein the locking unit further comprises a pawl arm disposed at the ring body, the case comprises a plurality of inner teeth, when the locking unit is at the first position, the pawl arm is engaged with the inner teeth to prohibit the spool from rotating toward the loosening direction, and the pawl arm is disengaged with the inner teeth in a tightening direction which is opposite to the loosening direction.

4. The fastening device of claim 2, wherein the locking unit further comprises a pawl arm disposed at the ring body, the pawl arm extends outwardly from the ring body in the radial direction, and the first retaining portion and the second retaining portion extend inwardly from the ring body in the radial direction.

5. The fastening device of claim 4, wherein the knob further comprises two protrusions coupled to the first retaining portion and the second retaining portion, respectively, and when the locking unit is driven by the knob to be switched from the first position to the second position, the first retaining portion and the second retaining portion are pushed by the protrusions, respectively, to move in the redial direction.

6. The fastening device of claim 1, wherein the case comprises a housing which comprises a lower opening and two side holes, and the spool comprises:

a spool cylinder, comprising a first opening and a second opening; and a bottom, configured for disposing the spool cylinder, the bottom comprising a first knotting hole, a first through hole, a second knotting hole and a second through hole, the first knotting hole and the first through hole being communicated with the first opening, the second knotting hole and the second through hole being communicated with the second opening;

wherein a first end of the lace is exposed from the lower opening after passing through one of the side holes, the first opening, the first knotting hole and the first through hole, and a second end of the lace is exposed from the lowing opening after passing though the other one of the side holes, the second opening, the second knotting hole and the second through hole.

7. The fastening device of claim 1, wherein:

the engaged portion extends inwardly away from the inner wall of the knob and toward an imaginary vertical center line of the fastening device, the engaged portion comprising top and bottom surfaces each extending inwardly away from the inner wall of the knob and toward the imaginary vertical center line;

the case has an outer wall;

the mounted portion extends outwardly from the outer wall of the case and away from the imaginary vertical center line, and has upper and lower surfaces each extending outwardly from the outer wall of the case and away from the imaginary vertical center line; and the top surface of the engaged portion abuts against the lower surface of the mounted portion when the engaged portion is engaged with the mounted portion.

8. A fastening device, which is for fastening and loosening a lace, the fastening device composed of a case, a spool, a knob and a locking unit, wherein:

the case comprises:

a housing comprising a mounted portion; and a base, configured for disposing the housing;

the spool is disposed at the case, and a lace is wound around the spool;

the knob is disposed at the housing, and the knob comprises:

an inner wall;

an engaged portion, disposed at the inner wall, the engaged portion being engaged with the mounted portion, such that the knob is coupled to the housing; and a spiral track, disposed at the inner wall; and the locking unit coupled to the knob, the locking unit comprising a guiding portion coupled to the spiral track so as to be driven by the knob;

rotating the knob relative to the case allows the locking unit to be driven to be switched from a first position to a second position, the locking unit is coupled to the spool to prohibit the spool from rotating toward a loosening direction when the locking unit is at the first position, and the spool is allowed to be rotated toward the loosening direction when the locking unit is at the second position.

9. The fastening device of claim 8, wherein the locking unit comprises:

a ring body, having a radial direction; and a first retaining portion and a second retaining portion, disposed at the ring body and coupled to the knob, each of the first retaining portion and the second retaining portion has restoring capability in the redial direction.

10. The fastening device of claim 9, wherein the locking unit further comprises a pawl arm disposed at the ring body, the pawl arm extends outwardly from the ring body in the radial direction to detachably engage with a plurality of inner teeth of the housing, the first retaining portion and the second retaining portion extend inwardly from the ring body in the radial direction, and detachably engage with two protrusions of the knob.

11. The fastening device of claim 8, wherein the case comprises a housing which comprises a lower opening and two side holes, and the spool comprises:

a spool cylinder, comprising a first opening and a second opening; and a bottom, configured for disposing the spool cylinder, the bottom comprising a first knotting hole, a first through hole, a second knotting hole and a second through hole, the first knotting hole and the first through hole being communicated with the first opening, the second knotting hole and the second through hole being communicated with the second opening;

wherein a first end of the lace is exposed from the lower opening after passing through one of the side holes, the first opening, the first knotting hole and the first through hole, and a second end of the lace is exposed from the lowing opening after passing though the other one of the side holes, the second opening, the second knotting hole and the second through hole.

12. A lace assembling method, which is for connecting a lace to a fastening device, the lace assembling method comprising:

providing a fastening device, wherein the fastening device is composed of a case, a spool, a knob and a locking unit, the case comprises a housing, the housing comprises a mounted portion, the knob comprises an engaged portion for engaging the mounted portion, the spool is disposed inside the housing, the locking unit is coupled to the spool and the knob, and operation of the knob causes the locking unit to move axially relative to the spool; and providing a lace coupling process, wherein a first end of the lace and a second end of the lace are exposed from the case after passing though the case and the spool, such that a user knot the first end and the second end to allow the lace to be coupled to the spool.

13. The lace assembling method of claim 12, wherein the case further comprises two side holes and a lower opening, the spool comprises a spool cylinder and a bottom, the spool cylinder comprises a first opening and a second opening, the bottom is for disposing the spool cylinder and comprises a first knotting hole, a first through hole, a second knotting hole and a second through hole, the first knotting hole and the first through hole are communicated with the first opening, the second knotting hole and the second through hole are communicated with the second opening, in the lacing coupling process, the first end of the lace is exposed from the lower opening after passing through one of the side holes, the first opening, the first knotting hole and the first through hole to allow being knotted by the user, and the second end of the lace is exposed from the lower opening after passing through the other one of the side holes, the second opening, the second knotting hole and the second through hole to allow being knotted by the user.

* * * * *